US011428127B2

(12) United States Patent
DiMaro et al.

(10) Patent No.: US 11,428,127 B2
(45) Date of Patent: Aug. 30, 2022

(54) CASTELLATION DEVICE, MECHANICAL CAPSULE, AND ROCKER ARM

(71) Applicant: Eaton Intelligent Power Limited, Dublin (IE)

(72) Inventors: Raffaele DiMaro, Naples (IT); Marco Ravoni, Rome (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/424,944

(22) PCT Filed: Feb. 19, 2021

(86) PCT No.: PCT/EP2021/025070
§ 371 (c)(1),
(2) Date: Jul. 22, 2021

(87) PCT Pub. No.: WO2021/164949
PCT Pub. Date: Aug. 26, 2021

(65) Prior Publication Data

US 2022/0145781 A1 May 12, 2022

Related U.S. Application Data

(60) Provisional application No. 62/978,815, filed on Feb. 19, 2020.

(51) Int. Cl.
*F01L 13/00* (2006.01)
*F01L 1/22* (2006.01)
(Continued)

(52) U.S. Cl.
CPC ..... *F01L 13/0005* (2013.01); *F01L 1/22* (2013.01); *F01L 1/46* (2013.01); *F01L 1/181* (2013.01); *F01L 2001/467* (2013.01)

(58) Field of Classification Search
CPC ..... F01L 1/181; F01L 1/22; F01L 1/46; F01L 2001/467; F01L 13/0005
(Continued)

(56) References Cited

U.S. PATENT DOCUMENTS 4,200,081 A 4/1980 Meyer et al.
4,227,494 A 10/1980 Uitvlugt
(Continued)

FOREIGN PATENT DOCUMENTS

WO WO-2014/001560 A1 1/2014
WO WO-2016/207348 A1 12/2016
(Continued)

OTHER PUBLICATIONS

International Search Report and Written Opinion for PCT/EP2021/025070; dated Jun. 11, 2021, pp. 1-5.

*Primary Examiner* — Jorge L Leon, Jr.
(74) *Attorney, Agent, or Firm* — Mei & Mark, LLP

(57) ABSTRACT

A castellation device comprises a shaft surrounded by three castellation members. A first castellation member is rotatably mounted on the shaft and comprises a first end and a second end opposite to the first end. A second castellation member is slidably mounted along the shaft adjacent the first end of the first castellation member. A third castellation member is mounted to the shaft adjacent the second end of the first castellation member. A bias spring is disposed between the second castellation member and the third castellation member and is configured to bias the second castellation member away from the third castellation member. Optionally, an annular shroud can enclose the three castellation members. The first castellation member is rotatable relative to the second and third castellation members between a first position and a second position.

25 Claims, 2 Drawing Sheets

(51) Int. Cl.
*F01L 1/46* (2006.01)
*F01L 1/18* (2006.01)

(58) Field of Classification Search
USPC ..... 123/90.45, 90.52
See application file for complete search history.

(56) References Cited

U.S. PATENT DOCUMENTS

| | | | |
|---|---|---|---|
| 6,273,039 | B1 | 8/2001 | Church |
| 6,354,265 | B1 | 3/2002 | Hampton et al. |
| 2015/0159520 | A1 | 6/2015 | Cecur |
| 2017/0051638 | A1 | 2/2017 | Cecur |
| 2017/0051639 | A1 | 2/2017 | Cecur |
| 2018/0187579 | A1 | 7/2018 | Cecur |
| 2020/0325803 | A1 | 10/2020 | Patil et al. |

FOREIGN PATENT DOCUMENTS

| | | | | |
|---|---|---|---|---|
| WO | WO-2019/036272 A1 | 2/2019 | | |
| WO | WO-2019036272 A1 * | 2/2019 | ..... | F01L 1/047 |
| WO | WO-2019/133658 A1 | 7/2019 | | |
| WO | WO-2019133658 A1 * | 7/2019 | ..... | F01L 1/181 |

* cited by examiner

CASTELLATION DEVICE, MECHANICAL CAPSULE, AND ROCKER ARM

This is a § 371 National Stage Entry of PCT/EP2021/025070 filed Feb. 19, 2021, and claims the benefit of U.S. provisional application 62/978,815 filed Feb. 19, 2020, all of which priority applications are incorporated herein by reference.

FIELD

This application provides a mechanical capsule and castellation device usable in a variety of valvetrain actuations, and particularly in a rocker arm. The castellation device can be configured with a large switchable stroke.

BACKGROUND

Rocker arm systems, valvetrain systems, rocker arms, and valve actuating assemblies herein can comprise alternative castellation mechanisms such as those described in, for example, WO 2019/133658, WO 2019/036272, US2020/0325803, US2018/0187579, U.S. Pat. Nos. 4,227,494, 6,354,265, 6,273,039, & U.S. Pat. No. 4,200,081. The castellation device disclosed herein can be used in rocker arm systems, valvetrain systems, rocker arms, and valve actuating assemblies such as those disclosed in these same exemplary publications. The castellation device herein can be used in other systems where switchable mechanisms are employed.

SUMMARY

The methods and devices disclosed herein improve the art by way of a castellation device and mechanical capsule with a large switchable stroke. A rocker arm or other valvetrain component can benefit from the castellation device.

A castellation device comprises a shaft surrounded by three castellation members. A first castellation member is rotatably mounted on the shaft and comprises a first end and a second end opposite to the first end. A second castellation member is slidably mounted along the shaft adjacent the first end of the first castellation member. A third castellation member is mounted to the shaft adjacent the second end of the first castellation member. A bias spring is disposed between the second castellation member and the third castellation member and is configured to bias the second castellation member away from the third castellation member. Optionally, an annular shroud can enclose the three castellation members. The first castellation member is rotatable relative to the second and third castellation members between a first position and a second position.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 3B:
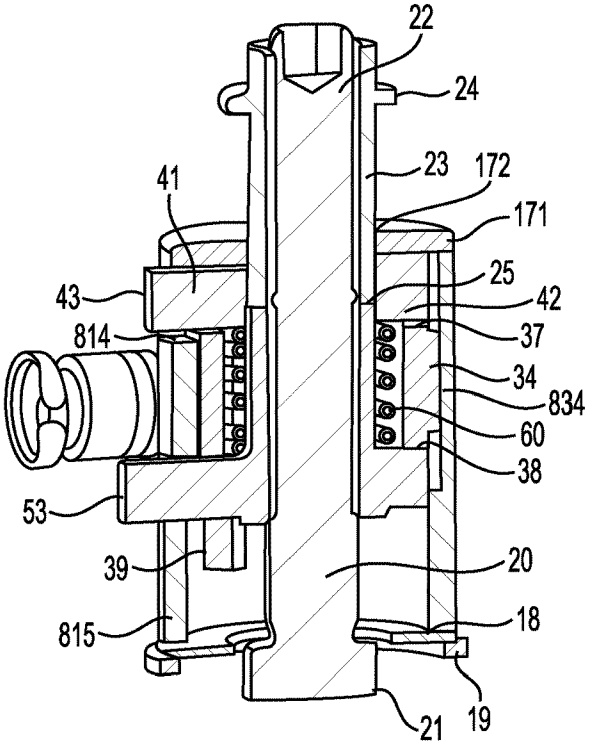
FIGS. 1, 3A, & 3B are views of a castellation device comprising an annular shroud.

Reference will now be made in detail to the examples which are illustrated in the accompanying drawings. Directional references such as "left" and "right" are for ease of reference to the figures.

A castellation device is disclosed to comprise an extended lost motion stroke. The castellation device can constitute a mechanical capsule that is suitable to enable extended travel in various variable valvetrain applications and mechanical switching applications.

The mechanical capsule is configured to switch between a second position configured to absorb a relative movement between two or more bodies and then return back to its mounting condition in a first position configured to transfer force therethrough. It is to be understood that, as a matter of design choice, the starting position can be the lost motion position configured to absorb relative motion with the second position being a tooth-engaged force transfer condition. So, designations of "first" and "second" positions can be for ease of antecedence in the claims. An actuation system (hydraulic, pneumatic or electromechanical) can be used to switch the mechanical capsule. With the mechanical capsule, it is possible to switch the castellation device between positions to absorb or transfer the max movement absorbed.

An exemplary actuator 70 is shown in the Figures to comprise a "rack and pinion" type arrangement, but numerous alternatives exist. Toothed arrangements and alternative linkages can be substituted for the rack gear 71 and pinion gear areas 74, 741. Rack 75 can be actuated by a linkage joined to it or by a supply such as hydraulic or pneumatic fluid. A plug 73 can be inserted in an actuator bore 13 so a bias 72, such as a spring 72, can push the rack 75 to a first position. Then, an opposing pressure from the fluid or linkage can push the rack 75 so that it turns either the annular shroud 80 or the first castellation member 30.

The mechanical capsule is able to absorb a relative movement between two or more bodies and to return back to its mounting condition through at least one return spring 60, also called a bias spring. Through an actuation system (hydraulic, pneumatic or electromechanical) it is possible for the mechanical capsule to transmit the motion between the bodies. The actuation movement and the absorption movement could be decoupled. The motion is transmitted through mechanical engagement of teeth. With this capsule it is possible to duplicate the max movement absorbed.

Figure 3A:
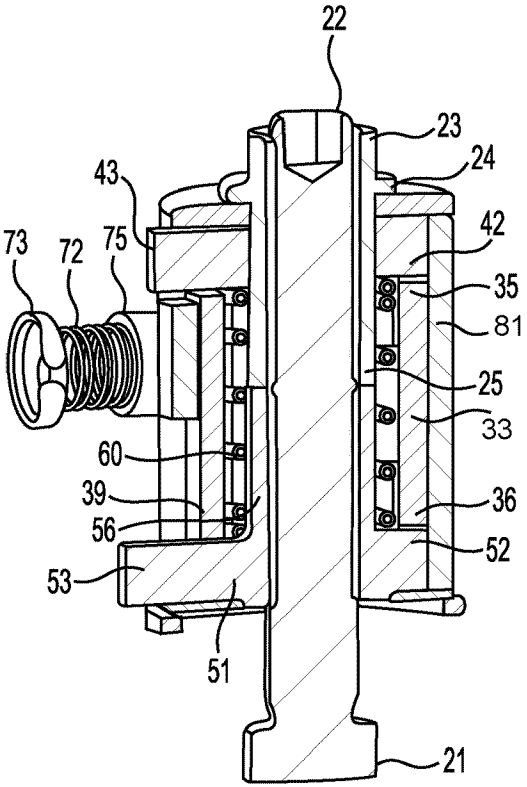
Figure 1:
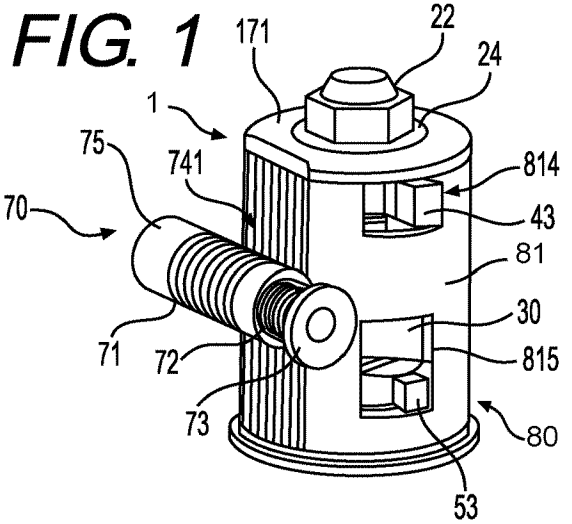

In FIGS. 1, 3A, & 3B, a first castellation device 1 constitutes a mechanical capsule comprising an annular shroud 80 coupled to a rack 75 of an actuator 70. This mechanical capsule can be drop-in assembled in a capsule bore 17. A bore end 171 can be a blind bore to seat the mechanical capsule but can also comprise a lash bore 172 through hole through which the shaft 20 can slide. Rocker arm 10 is shown to comprise the capsule bore 17 with a positioning washer 18 and snap ring 19 to hold the castellation device 1 within. Return spring 60, first, second and third castellation members 30, 50, 40 can be dropped into capsule bore 17, with shaft 20 threaded therethrough. Washer 18 & snap ring 19, or other locking device such as a set screw, pressed bushing, among others, prevents the castellation device 1 or 2 from falling out of the capsule bore 17. Washer 18 or snap ring 19 or other locking device can serve as a travel limit for shaft 20, as by obstructing the travel of press foot 21 or e-foot 16.

A lash sleeve 23, or lash adjustment screw, can be fitted or fixed, as by threading or press-fitting, to a lash end 22 of shaft 20. Lash sleeve 23 can be positioned on shaft 20 to control the lash of the castellation device 1 or 2 or lash sleeve 23 can control, via positioning of its sleeve end 25, the travel length that the castellation device 1 or 2 collapses in lost motion. A travel stop 24 can be included to catch on the lash bore 172 or bore end 171. Shaft 20 can also comprise a press foot 21 configured to press on a valve stem, valve bridge, other rocker arm, or other valvetrain component. An e-foot (elephant foot) arrangement 16 can also be accomplished on the shaft 20 as by attaching the appropriate socket arrangement to the shaft 20.

Rocker arm 10 can comprise a body 11, valve end 12, and actuation end 121. Numerous alternatives exist. Instead of a rocker shaft bore and roller, a tappet end can be used. Or, the rocker arm can be configured for overhead cam actuation applications, or pushrod actuation applications, among alternatives.

The first, second and third castellation members 30, 50, 40 can be keyed to the annular shroud 80. Annular shroud 80 can comprise a shroud body 81 with the pinion gear area 741 or other coupling area for rotational actuation of the annular shroud 80. An upper keyhole 814 can receive an upper positioning key 43. A lower keyhole 815 can receive a lower positioning key 53. An inner keyway 834 can receive a middle positioning key 34. Rectilinear keyed relationships are shown but other shapes can be used, such as pegs, wedges, ball and socket, among others. The keyed relationships can be used as travel stops and travel guides for the first, second and third castellation members 30, 50, 40. For example, the inner keyway 834 can guide the first castellation member 30 as it rotates and can include terminal walls to restrict the extent of the rotation. Similarly, the upper and lower keyholes 814, 815 can prevent or restrict rotation of second and third castellation members 50, 40. Upper and lower keyholes 814, 815 can restrict or guide the movement of second and third castellation members 50, 40 during lost motion and during force transfer, as by preventing or limiting side-to-side motion relative to the shaft 20.

Figure 2:
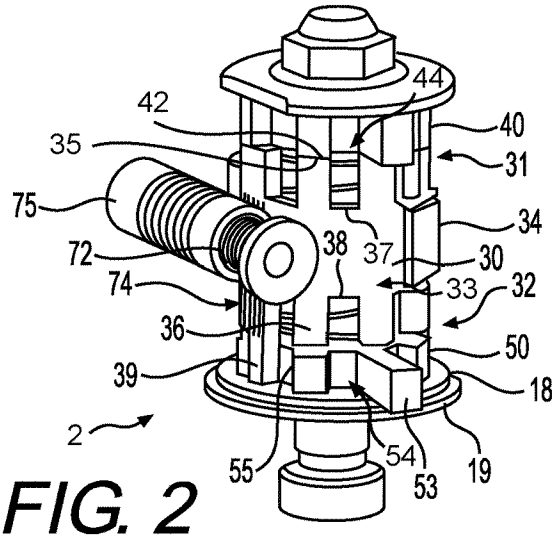
FIG. 2 is a view of a castellation device suitable for drop in assemblies.
Figure 4:
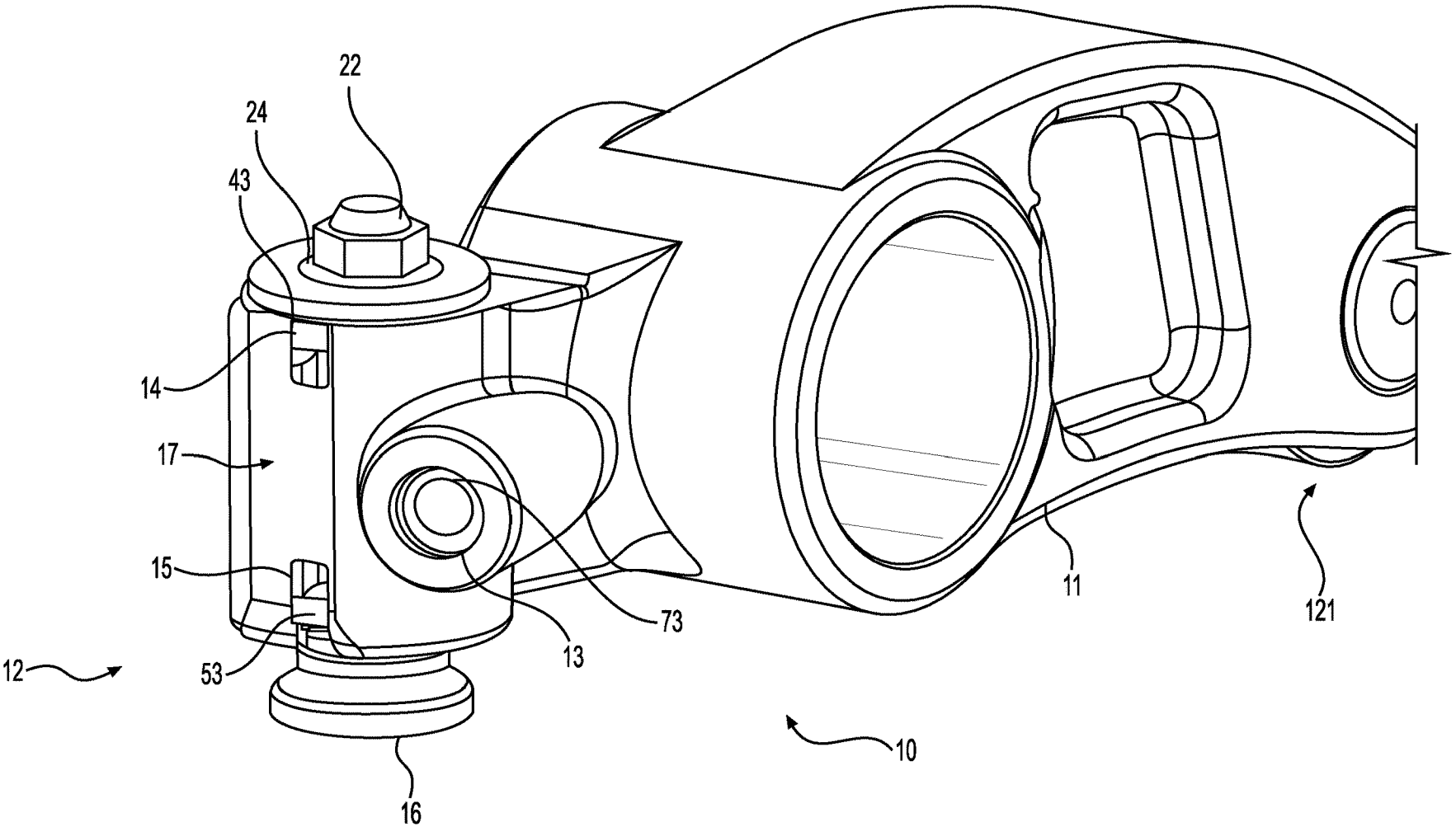
FIG. 4 is an example of a rocker arm with the drop in castellation device installed.

In FIGS. 2 & 4, the annular shroud 80 is removed, and the rack 75 of an actuator 70 is coupled to the first castellation member 30. Now, the capsule bore 17 can mimic the keyed relationships of the annular shroud 80, as by capsule bore 17 comprising an upper keyhole 14 for upper positioning key 43, a lower keyhole 15 for lower positioning key 53, and an inner groove for middle positioning key 34. With appropriate grooves in the capsule bore 17, the first, second and third castellation members 30, 50, 40 can be keyed to the capsule bore of other valvetrain or switchable devices, such as the rocker arm or other valvetrain component.

In FIG. 3A, the mechanical capsule is in an "on" position. When installed in a rocker arm, the castellation device 1 can transfer an engine braking, added motion, or normal lift profile. When installed in other valvetrain systems or a rocker arm, the tooth-to-tooth contact among the first, second and third castellation members 30, 50, 40 is achieved.

In FIG. 3B, the mechanical capsule is in an "off" position. When installed, the castellation device 1 can absorb the engine braking, added motion, or normal lift profile so that one of no lift profile or a shorter lift profile is transferred through the rocker arm. When installed in other valvetrain systems or rocker arm, the tooth-to-cavity alignment among the first, second and third castellation members 30, 50, 40 is achieved. The castellation device is collapsible in FIG. 3B.

In light of the above alternatives, a castellation device 1, 2 can comprise a shaft 20 configured as a central force-transfer axis. Shaft 20 can move slidably within castellation device 1, 2, with travel stops provided via arrangements, such as rim, snap ring, diameter changes, among others, at either end of the shaft 20 and corresponding catches, such as diameter changes, washers, rings, tabs, bushings, bores, among others.

A first castellation member 30 can be rotatably mounted on the shaft 20. First castellation member 30 can comprise a tubular body 33 with first end 32 and a second end 31 opposite to the first end 32. The middle positioning key 34 can extend out from the tubular body 33. A linkage or gear arrangement can be formed on the exterior of the tubular body 33 for coupling to an actuator, such as actuator 70. Upper teeth 35 (first teeth) can be separated by upper cavities 37 (first cavities). Lower teeth 36 (second teeth) can be separated by lower cavities 38 (second cavities). A guiding tooth 39 can be included as a travel stop that limits the relative travel of the first castellation member 30 relative to a guide slot 55 of the second castellation member. A height of guiding tooth 39 can be selected so that guiding tooth 39 can also position the first castellation member 30 axially along the shaft 20, as by abutting washer 18 when the return spring 60 is fully extended and pushing the second and third castellation members 50, 40 apart. The height of the guiding tooth 39 can ensure separation of the first and second castellation members 30, 50 so that their teeth can rotate relative to one another. First castellation member 30 can be configured to surround the shaft 20 and return spring 60.

A second castellation member 50 can be mounted along the shaft 20 adjacent the first end 32 of the first castellation member 30. A through hole in the body 51 of the second castellation member 50 permits a sliding relationship with the shaft 20 so that the shaft 20 is mounted slidably and the second castellation member 50 is mounted slidably. Second castellation member 50 can comprise a body 51 with a spring seating area for return spring 60. Return spring 60 can surround a guide shaft 56 extending from the body 51. Guide shaft 56 can have a height selected to interface with sleeve end 25 and can also have a diameter to act as a travel stop against third castellation member body 41. Return spring 60 can be guided by guide shaft 56. Guide shaft 56 slides within first castellation member 30. Body 51 can comprise integrally formed teeth 52, cavities 54, guide slot 55, and positioning key 53.

Third castellation member 40 can be mounted to surround a portion of the shaft 20, including abutting the lash sleeve 23 integrated with the shaft 20. Third castellation member 40 can be adjacent the second end 31 of the first castellation member 30. Third castellation member 40 can be mounted in the capsule bore 17 to abut the bore end 171. One or more upper positioning key 43 can be configured in the capsule bore 17, annular shroud 80, or both, so that third castellation member 40 remains abutting the bore end 171 under all operating conditions. Whether the teeth 42 abut upper teeth 35 or upper cavities 37, the third castellation member can remain secured against the bore end 171. Or, a limited travel can be built in via the upper keyhole 14, 814. First castellation member 30 can be said to abut or slide into third castellation member 40 via the arrangement of teeth and cavities relative to the annular configurations. Body 41 of third castellation member 40 can provide a spring seat for return spring 60 so that return spring 60 can push the second and third castellation members 50, 40 apart.

Return spring 60, also called a bias spring, is efficiently packaged within and around pieces of the castellation device 1, 2. Return spring 60 can be disposed between the second castellation member 50 and the third castellation member 40 and can be configured to bias the second castellation member 50 away from the third castellation member 40. Return spring 60 can be disposed in an annular space between the shaft 20 and the first castellation member 30. Axial bending of the return spring 60 is limited by its housed configuration. And, its footprint is kept small.

The first castellation member 30 is rotatable relative to the second and third castellation members 50, 40 between a first position and a second position (FIGS. 3A & 3B, interchangeably for purposes of enforcement). The second castellation member 50 is prevented from sliding toward the third castellation member 40 when the first castellation member 30 is in the first position. The second castellation member 50 is slidable toward the third castellation member 40 when the first castellation member 30 is in the second position. This sliding and prevention of sliding is accomplished via switchably controlling the alignment of the several sets of teeth or subsets of teeth 35, 36, 42, 52 with subsets of cavities 37, 38, 44, 54.

Optional annular shroud 80 can substantially enclose the first, second, and third castellation members 30, 50, 40. Annular shroud 80 can be configured to interface with an actuator 70 configured to rotate the first castellation member 30 relative to the second and third castellation members 50, 40 between the first position and the second position. The first castellation member 30 can alternatively be configured to interface with the actuator 70 configured to rotate the first castellation member 30 relative to the second and third castellation members 50, 40 between the first position and the second position.

When the first castellation member 30 is in the first position (FIG. 3A), first teeth 36 on the first end 32 of the first castellation member 30 align with teeth 52 of the second castellation member 50. And, second teeth 35 on the second end 31 of the first castellation 30 member align with teeth 42 of the third castellation member 40. But, when the first castellation member 30 is in the second position (FIG. 3B), first teeth 36 on the first end 32 of the first castellation member 30 align with cavities 54 of the second castellation member 50. And, second teeth 35 on the second end 31 of the first castellation member 30 align with cavities 44 of the third castellation member 40. The first castellation member 30 is slidable toward the third castellation member 40 when the first castellation member 30 is in the second position. The second castellation member 50 is slidable toward the first castellation member 30 when the first castellation member 30 is in the second position.

First castellation member 30 can comprise an annular body 33, also called a tubular body. First teeth 36 can extend axially, and optionally radially, from the annular body 33 at the first end 32. Second teeth 35 can extend axially, and optionally radially, from the annular body 33 at the second end 31.

Second castellation member 50 can comprise an annular ring form by the body 51 and a plurality of radial teeth 52 extending radially, and optionally axially, from the annular ring. An internal radius of the annular body 33 of the first castellation member 30 can be greater than the outer radius of the annular ring of the second castellation member 50. This can facilitate a compact stacking of the castellation members and a much longer stroke length since the second castellation member 50 can collapse into the first castellation member 30.

First teeth 36 of the first castellation member 30 can contact the radial teeth 52 of the second castellation member 50 when the first castellation member 30 is in the first position. The first teeth 36 can engage, and collapse into, cavities 54 formed between the radial teeth 52 of the second castellation member 50 when the first castellation member 30 is in the second position. Compactness and long stroke is achieved with low material use.

Third castellation member 40 can comprise a body 41 formed of a tube shape positioned relative to the shaft 20. An annular rim can extend from the tube shape. Annular rim can form the spring seat for return spring 60. A plurality of radial teeth 42 can extend radially, and optionally axially, from the outer surface of the annular rim. The internal radius of the annular body 33 of the first castellation member 30 can be greater than the radius of the outer surface of the annular rim of the third castellation member 40. That is, the first castellation member 30 can slide over a majority of third castellation member 40 during lost motion and collapse of the castellation device 1, 2. Second teeth 35 of the first castellation member 30 can contact the radial teeth 42 of the third castellation member 40 when the first castellation member 30 is in the first position and can engage, and alternatively collapse into, cavities 44 formed between the radial teeth 42 of the third castellation member 40 when the first castellation member 30 is in the second position.

An annular shroud 80 can optionally substantially enclose the first, second, and third castellation members 30, 50, 40. Bore end 171 can be formed as an integral part of capsule bore 17 or bore end 171 can comprise a top plate secured to the capsule bore 17. Top plate can be disposed, as an alternative to or in addition to bore end 171, at a first end of the annular shroud 80. A bottom plate, in the form or washer 18 or other fitting, can be disposed at a second end, opposite to the first end, of the annular shroud 80. The annular shroud 80, the top plate, and the bottom plate 18 can be configured to be slidable along the shaft 20 to form a castellation capsule that can be anchored to a capsule bore 17 or other valvetrain component. The annular shroud can be rotatably fixed with the first castellation member 30. Rotating the annular shroud can cause the rotation of the first castellation member 30.

First castellation member 30 can comprises a first tab, also called positioning key 34, extending from the annular body 33. Annular shroud 80 can comprise a first groove, also called inner keyway 834, for receiving the first tab to fix the annular shroud 80 with the first castellation member 30. Second castellation member 50 can comprise a second tab, also called lower positioning key 53, extending from the annular ring of body 51. Annular shroud 80 can comprise a first tab pass-through, also called lower keyhole 815, for receiving the second tab to position the second castellation member 40 with respect to the annular shroud 80. Third castellation member 40 can comprise a third tab, also called upper positioning key 43, extending from the annular rim of body 41. Annular shroud 80 can comprise a second tab pass-through, also called upper keyhole 814, for receiving the third tab to position the third castellation member 40 with respect to the annular shroud 80.

Annular shroud 80 can comprise a plurality of radial ribs, also called pinion gear area 741 for engaging an actuator 70. The actuator can comprise a tubular member, illustrated as rack 75, having at least one annular flange, illustrated as rack gears 71. The tubular member can be extendable in a direction substantially perpendicular to a longitudinal axis of the shaft 20 to rotate the first castellation member 30 between the first position and the second position. Actuator 70 can be one of a hydraulic actuator, a pneumatic actuator, and an electromechanical actuator, as by attachment of appropriate linkages and control mechanisms, such as solenoids, oil control valves, ports, supply lines, compressors, and the like. Linear motion of the rack 75 in this example causes rotational motion of the annular shroud 80 and first castellation member 30. Interaction of upper keyhole 814 with upper positioning key 43 and interaction of lower keyhole 815 with lower positioning key 53 can be such that the upper and lower keyholes 814, 815 are larger than the upper and lower positioning keys 43, 53. Then, when the annular shroud 80 moves, it can drag and realign the second and third castellation members 50, 40.

It is possible for a rocker arm to comprise one of the castellation devices 1, 2. That is, the rocker arm can comprise a castellation device 1, 2 with or without the annular shroud 80.

Other implementations will be apparent to those skilled in the art from consideration of the specification and practice of the examples disclosed herein.

What is claimed is:

1. A castellation device, comprising:

a shaft;

a first castellation member rotatably mounted on the shaft and comprising a first end and a second end opposite to the first end;

a second castellation member slidably mounted along the shaft adjacent to the first end of the first castellation member;

a third castellation member mounted to the shaft adjacent to the second end of the first castellation member;

an annular shroud substantially enclosing the first, second, and third castellation members, the annular shroud configured to interface with an actuator configured to rotate the first castellation member relative to the second and third castellation members between a first position and a second position; and a bias spring disposed between the second castellation member and the third castellation member and configured to bias the second castellation member away from the third castellation member, wherein the second castellation member is prevented from sliding toward the third castellation member when the first castellation member is in the first position, and wherein the second castellation member is configured to slide toward the third castellation member when the first castellation member is in the second position.

2. The castellation device of claim 1, wherein when the first castellation member is in the first position, first teeth on the first end of the first castellation member align with teeth of the second castellation member, and second teeth on the second end of the first castellation member align with teeth of the third castellation member.

3. The castellation device of claim 2, wherein when the first castellation member is in the second position, first teeth on the first end of the first castellation member align with cavities of the second castellation member, and second teeth on the second end of the first castellation member align with cavities of the third castellation member.

4. The castellation device of claim 3, wherein the first castellation member is configured to slide toward the third castellation member when the first castellation member is in the second position.

5. The castellation device of claim 4, wherein the second castellation member is configured to slide toward the first castellation member when the first castellation member is in the second position.

6. The castellation device of claim 3, further comprising a lash adjustment screw fixed to the shaft.

7. The castellation device of claim 3, wherein the first castellation member further comprises a first tab extending radially from an annular body, and wherein the annular shroud comprises a first groove receiving the first tab so as to couple the annular shroud to the first castellation member.

8. The castellation device of claim 7, wherein the second castellation member further comprises a second tab extending from an annular ring, and wherein the annular shroud comprises a first tab pass-through configured to receive the second tab so as to position the second castellation member with respect to the annular shroud.

9. The castellation device of claim 8, wherein the third castellation member further comprises a third tab extending from an annular rim, and wherein the annular shroud comprises a second tab pass-through configured to receive the third tab so as to position the third castellation member with respect to the annular shroud.

10. The castellation device of claim 3, wherein the bias spring is disposed in an annular space between the shaft and the first castellation member.

11. A rocker arm comprising the castellation device of claim 3.

12. A castellation device, comprising:

a shaft;

a first castellation member rotatably mounted on the shaft, the first castellation member comprising an annular body, first teeth extending axially from the annular body at a first end, and second teeth extending axially from the annular body at a second end;

a second castellation member mounted to slide along the shaft adjacent to the first end of the first castellation member;

a third castellation member mounted to the shaft adjacent to the second end of the first castellation member; and a bias spring biased from the second castellation member to the third castellation member, the bias spring configured to bias the second castellation member away from the third castellation member;

wherein the first castellation member is configured to rotate relative to the second and third castellation members between a first position and a second position, wherein the second castellation member is prevented from sliding toward the third castellation member when the first castellation member is in the first position, and wherein the second castellation member is configured to slide toward the third castellation member when the first castellation member is in the second position.

13. The castellation device of claim 12, wherein the first castellation member is configured to interface with an actuator configured to rotate the first castellation member relative to the second and third castellation members between the first position and the second position.

14. The castellation device of claim 12, wherein the third castellation member comprises a body formed in a tube shape positioned around the shaft, an annular rim extending from the body, and a plurality of radial teeth extending radially from an outer surface of the annular rim.

15. The castellation device of claim 14, wherein an internal radius of the annular body of the first castellation member is greater than an outer surface radius of the annular rim of the third castellation member.

16. The castellation device of claim 14, wherein the second teeth of the first castellation member contact the plurality of radial teeth of the third castellation member when the first castellation member is in the first position, and wherein the second teeth engage cavities formed between the plurality of radial teeth of the third castellation member when the first castellation member is in the second position.

17. A castellation device, comprising:

a shaft;

a first castellation member rotatably mounted on the shaft and comprising a first end and a second end opposite to the first end;

a second castellation member mounted to slide along the shaft adjacent to the first end of the first castellation member, the second castellation member comprising an annular ring and a plurality of radial teeth extending radially from the annular ring;

a third castellation member mounted to the shaft adjacent to the second end of the first castellation member; and a bias spring abutting the second castellation member and the third castellation member, the bias spring configured to bias the second castellation member away from the third castellation member;

wherein the first castellation member is configured to rotate relative to the second and third castellation members between a first position and a second position, wherein the second castellation member is prevented from sliding toward the third castellation member when the first castellation member is in the first position, and wherein the second castellation member is configured to slide toward the third castellation member when the first castellation member is in the second position.

18. The castellation device of claim 17, wherein the first castellation body comprises an annular body with an internal radius that is greater than an outer radius of the annular ring of the second castellation member.

19. The castellation device of claim 17, wherein first teeth of the first castellation member contact the plurality of radial teeth of the second castellation member when the first castellation member is in the first position, and wherein the first teeth engage cavities formed between the plurality of radial teeth of the second castellation member when the first castellation member is in the second position.

20. A castellation device, comprising:

a shaft;

a first castellation member rotatably mounted on the shaft and comprising a first end and a second end opposite to the first end;

a second castellation member mounted along the shaft adjacent to the first end of the first castellation member;

a third castellation member mounted to the shaft adjacent to the second end of the first castellation member;

a bias spring disposed between the second castellation member and the third castellation member and configured to bias the second castellation member away from the third castellation member; and an annular shroud substantially enclosing the first, second, and third castellation members;

a top plate disposed at a first end of the annular shroud; and a bottom plate disposed at a second end of the annular shroud opposite to the first end of the annular shroud, wherein the first castellation member is configured to rotate relative to the second and third castellation members between a first position and a second position, wherein the second castellation member is prevented from sliding toward the third castellation member when the first castellation member is in the first position, and wherein the second castellation member is configured to slide toward the third castellation member when the first castellation member is in the second position.

21. The castellation device of claim 20, wherein the shaft is configured to slide within the annular shroud, the top plate, and the bottom plate.

22. The castellation device of claim 20, wherein the annular shroud is coupled to the first castellation member such that rotation of the annular shroud causes the rotation of the first castellation member.

23. The castellation device of claim 20, wherein the annular shroud comprises a plurality of radial ribs configured to engage an actuator.

24. The castellation device of claim 23, wherein the actuator comprises a tubular member having at least one annular flange, the tubular member extending in a direction substantially perpendicular to a longitudinal axis of the shaft so as to rotate the first castellation member between the first position and the second position.

25. The castellation device of claim 23, wherein the actuator is one of a hydraulic actuator, a pneumatic actuator, and an electromechanical actuator.

* * * * *